US010341781B2

(12) United States Patent
Chen et al.

(10) Patent No.: US 10,341,781 B2
(45) Date of Patent: Jul. 2, 2019

(54) DOUBLE RING RADIATOR AND DUAL CO-AX DRIVER

(71) Applicant: Tymphany HK, Wanchai (HK)

(72) Inventors: Zhi Chen, Changsha (CN); Li Gang, Guangzhou (CN)

(73) Assignee: TYMPHANY HK LIMITED, Wan Chai (HK)

( * ) Notice: Subject to any disclaimer, the term of this patent is extended or adjusted under 35 U.S.C. 154(b) by 0 days.

(21) Appl. No.: 15/425,080

(22) Filed: Feb. 6, 2017

(65) Prior Publication Data

US 2017/0245058 A1 Aug. 24, 2017

Related U.S. Application Data

(60) Provisional application No. 62/292,132, filed on Feb. 5, 2016.

(51) Int. Cl.

| | |
|---|---|
| ***H04R 9/06*** | (2006.01) |
| ***H04R 9/02*** | (2006.01) |
| ***H04R 1/34*** | (2006.01) |

(52) U.S. Cl.

CPC ..... *H04R 9/063* (2013.01); *H04R 1/34* (2013.01); *H04R 9/025* (2013.01); *H04R 9/06* (2013.01); *H04R 2201/34* (2013.01); *H04R 2209/041* (2013.01); *H04R 2400/11* (2013.01)

(58) Field of Classification Search

CPC ..... H04R 9/025; H04R 9/045; H04R 9/046; H04R 9/06; H04R 9/063; H04R 2201/34; H04R 2209/041; H04R 2400/11; H04R 2400/13; H04R 1/34

USPC ..... 381/343, 182, 186, 400, 401, 412, 414, 381/420, 421, 422, 430; 181/164, 165, 181/171, 173

See application file for complete search history.

(56) References Cited

U.S. PATENT DOCUMENTS

| | | | | |
|---|---|---|---|---|
| 3,665,124 A * | 5/1972 | Sotome | ..... | H04R 9/063 181/171 |
| 5,604,815 A * | 2/1997 | Paddock | ..... | H04R 9/025 381/182 |
| 7,813,521 B2 * | 10/2010 | Lim | ..... | H04R 9/063 381/396 |
| 9,788,123 B2 * | 10/2017 | Sha | ..... | H04R 9/025 |

* cited by examiner

*Primary Examiner* — Huyen D Le

(74) *Attorney, Agent, or Firm* — Cantor Colburn LLP

(57) ABSTRACT

A driver for a loudspeaker including an inner magnet disposed within a housing, an outer magnet disposed within the housing radially outward of the inner magnet, an inner voice coil having a first diameter, an outer voice coil having a second diameter, the second diameter being larger than the first diameter, where poles of the inner and outer magnets are oppositely disposed, where the inner magnet is configured to contribute only to a magnetic circuit of the inner voice coil, and where the outer magnet is configured to contribute to the magnetic circuit of the inner voice coil and to a magnetic circuit of the outer voice coil.

13 Claims, 6 Drawing Sheets

1-plastic frame, 2-diaphragm, 3-outter coil-I, 4-ring shaped plastic spacer, 5-inner coil-II, 6-bucking magent or plastic spacer, 7-phase plug, 8-U yoke, 9-ring shaped magnet, 10-ring shaped magnet, 11-round main magnet, 12-round main top plate

DOUBLE RING RADIATOR AND DUAL CO-AX DRIVER

CROSS REFERENCE TO RELATED APPLICATIONS

This application is related to and claims the benefit of U.S. Provisional Patent Application Ser. No. 62/292,132 filed on Feb. 5, 2016. This application is also related to U.S. Pat. No. 6,980,664 granted on 27 Dec. 2005 which is the U.S. national stage entry of International Patent Application No. PCT/DK2002/00009 filed on 4 Jan. 2002, which claims priority to Danish Patent Application No. PA 20010013 filed on 4 Jan. 2001. This application is also related to U.S. Pat. No. 6,320,972 granted on 20 Nov. 2001 which claims priority to Danish Patent Application No. PA 199900213. The contents of all of said applications are herein incorporated by reference in their entirety.

TECHNICAL FIELD

The invention generally concerns sound production and delivery devices and, more particularly, a loudspeaker of the type in which a loudspeaker membrane is coupled to a moving voice coil disposed in a magnet air gap within a housing.

BACKGROUND

In existing double ring radiator designs, such as those disclosed in the above cross-referenced documents, a single ring-shaped magnet interacts with each of multiple voice coils in the same manner. Thus, sensitivity is moderate at best. A need exists for an improved double ring radiator configuration which increases sensitivity of the resulting loudspeaker while minimizing the components of the loudspeaker without increasing the overall size of the driver.

BRIEF SUMMARY

A driver for a loudspeaker is herein disclosed including an inner magnet disposed within a housing, an outer magnet disposed within the housing radially outward of the inner magnet, an inner voice coil having a first diameter, an outer voice coil having a second diameter, the second diameter being larger than the first diameter, where poles of the inner and outer magnets are oppositely disposed, where the inner magnet is configured to contribute only to a magnetic circuit of the inner voice coil, and where the outer magnet is configured to contribute to the magnetic circuit of the inner voice coil and to a magnetic circuit of the outer voice coil.

A loudspeaker is also disclosed as including the driver mentioned immediately above, a yolk having a generally U-shaped cross-section disposed at a rear of the driver, a frame secured to the yolk, and a diaphragm connected to the frame and extending across a front of the driver.

Also described herein is a method of driving a loudspeaker including providing an inner voice coil and a corresponding inner magnet, providing an outer voice coil and a corresponding outer magnet, the inner magnet contributing only to a magnetic circuit of the inner voice coil, the outer magnet contributing to the magnetic circuit of the inner voice coil and to a magnetic circuit of the outer voice coil.

The invention also concerns a method of driving a loudspeaker, and particularly a loudspeaker of a headphone, using the driver, loudspeaker, and method mentioned above.

DETAILED DESCRIPTION

Figure 1:
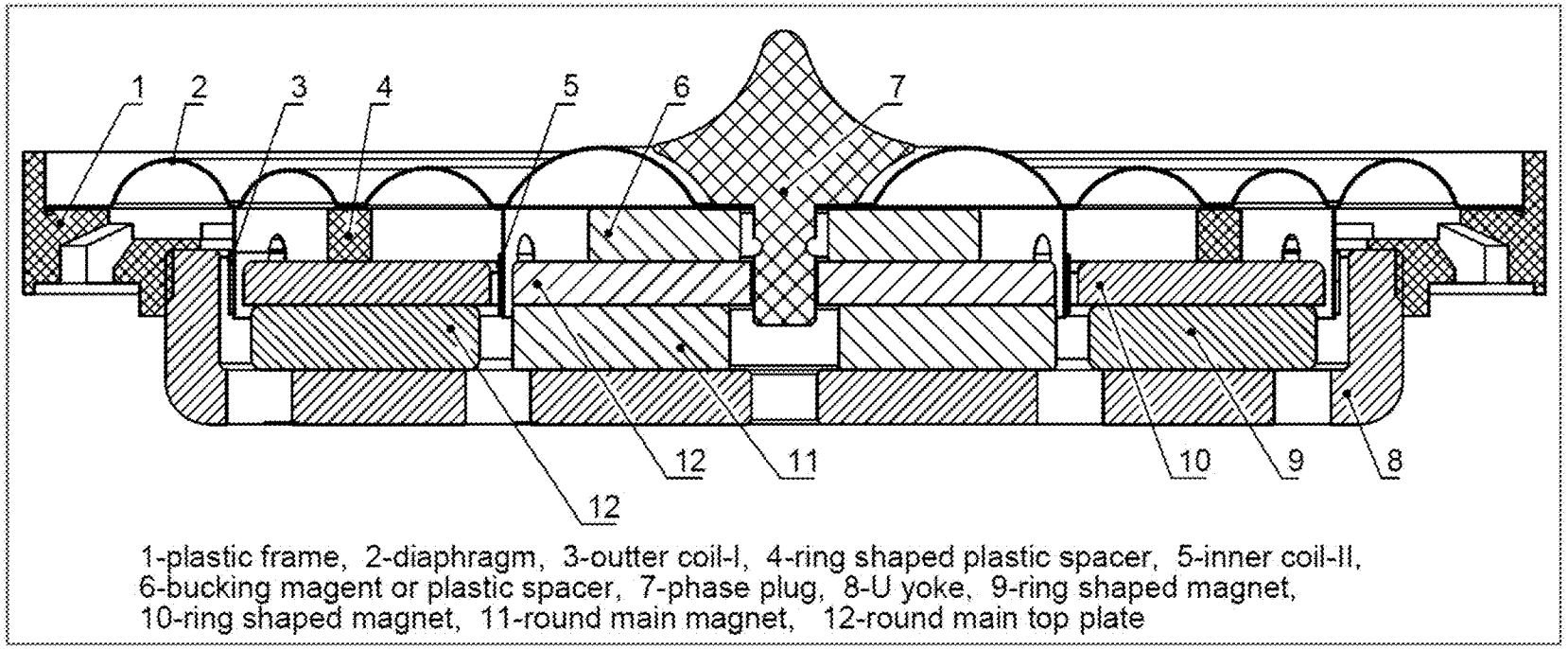
FIG. 1 shows a cross-sectional view of a loudspeaker in one exemplary embodiment of the invention.
Figure 2:
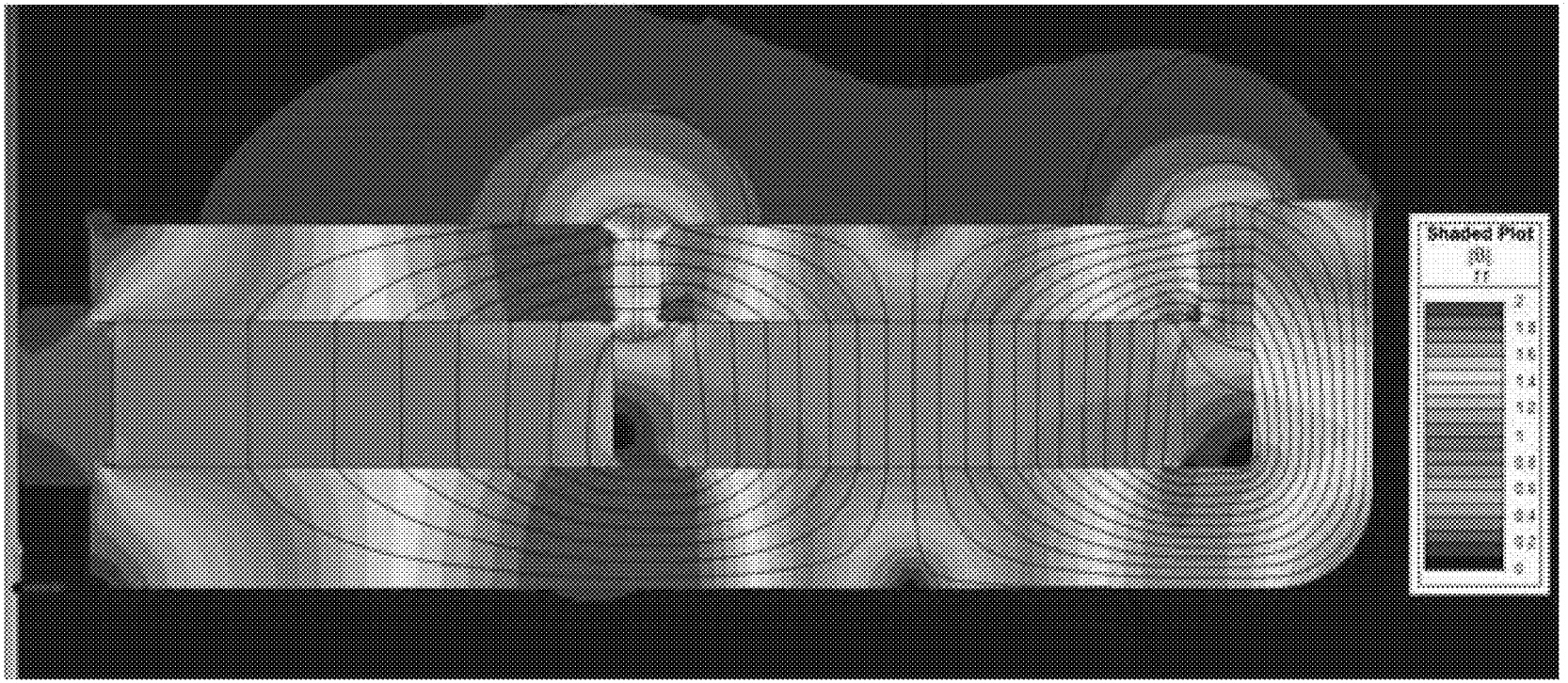
FIG. 2 shows the magnetic circuits of the loudspeaker of FIG. 1 when in use.

FIG. 1 illustrates an exemplary double ring radiator loudspeaker comprising a frame 1, a diaphragm 2 which extends on a first side of the loudspeaker from the frame 1 to a phase plug 7, and a yolk 8 which is connected to the frame 1 and extends across a second side of the loudspeaker opposite from the first side. At a central area of the loudspeaker, the plug 7 connects to top plate 12. A bucking magnet or spacer 6 is disposed on the top plate 12 proximate to the first side of the loudspeaker. An inner magnet 11 is disposed adjacent to the top plate 12, opposite from the spacer 6 and proximate to the second side of the loudspeaker. An inner voice coil 5 is disposed radially outward of the top plate 12, the spacer 6, and the inner magnet 11. A second outer magnet 9, 10 is disposed radially outward of the inner voice coil 5. Finally, an outer voice coil 3 is disposed radially outward of the second magnet 9, 10.

In one exemplary embodiment, the double ring radiator configuration of FIG. 1 is used as a headphone driver. The additional magnet (number 11 in FIG. 1) is added to the motor of the driver in order to increase the motor strength and thus, increase the sensitivity. In this configuration, there is an inner magnet 11 (which may be ring-shaped or not) and a ring-shaped outer magnet 9, 10. Importantly, these two magnets have their magnetic poles oriented in the opposite direction. This means that for the inner magnet 11, the north pole will be facing the first side of the driver whereas the north pole of the outer magnet 9, 10 will be oriented facing the opposite second side, or vice versa. These two magnets 11 and 9, 10 combined create a different magnetic path for each voice coil 3, 5. An important feature is that the inner magnet 11 contributes only to the coil with the smallest inner diameter, i.e., to the inner voice coil 5. Whereas, the outer magnet 9, 10 will contribute to the magnetic circuit of both coils, i.e., to the inner coil 5 and to the outer coil 3. See, for example, FIG. 3 which illustrates the magnetic circuits developed by the magnetic arrangement of the loudspeaker of FIG. 1. That is, each voice coil 3, 5 has its own magnetic circuit but, for the smallest coil 5, both magnets 9, 10, 11 are combined in a way that together create a stronger inner magnetic circuit. That is, the inner magnet 11 is subjected to a stronger magnetic force than the outer magnet. This requires the power of the magnets to be adjusted and designed (together with the shape and the rest of the motor parts) in a way that the magnetic field in the inner gap is boosted and not blocked or decreased. Usually bigger magnets provide stronger magnetic fields, that is why the inner magnet should equal or increase this strength or it will be not contributing or boosting the total magnetic force in the gap.

This configuration represents an improvement over known double ring radiator configurations in that the additional magnet in FIG. 1 contributes to an increase in the sensitivity of the loudspeaker while minimizing the elements required to put the loudspeaker into practice and without increasing the overall size of the driver.

Figure 3:
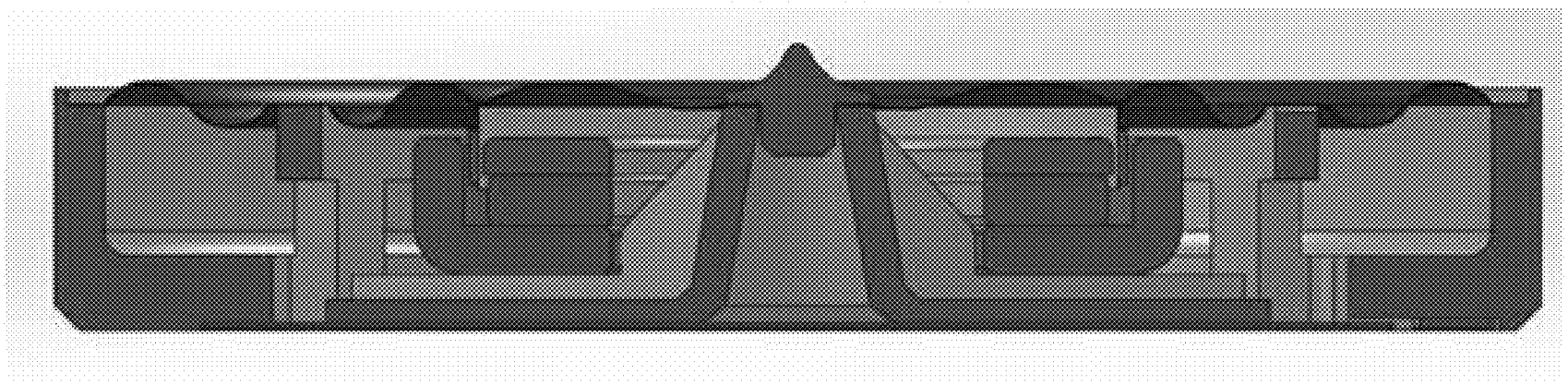
FIG. 3 is a cross-sectional view of a loudspeaker in another embodiment of the invention.
Figure 4:
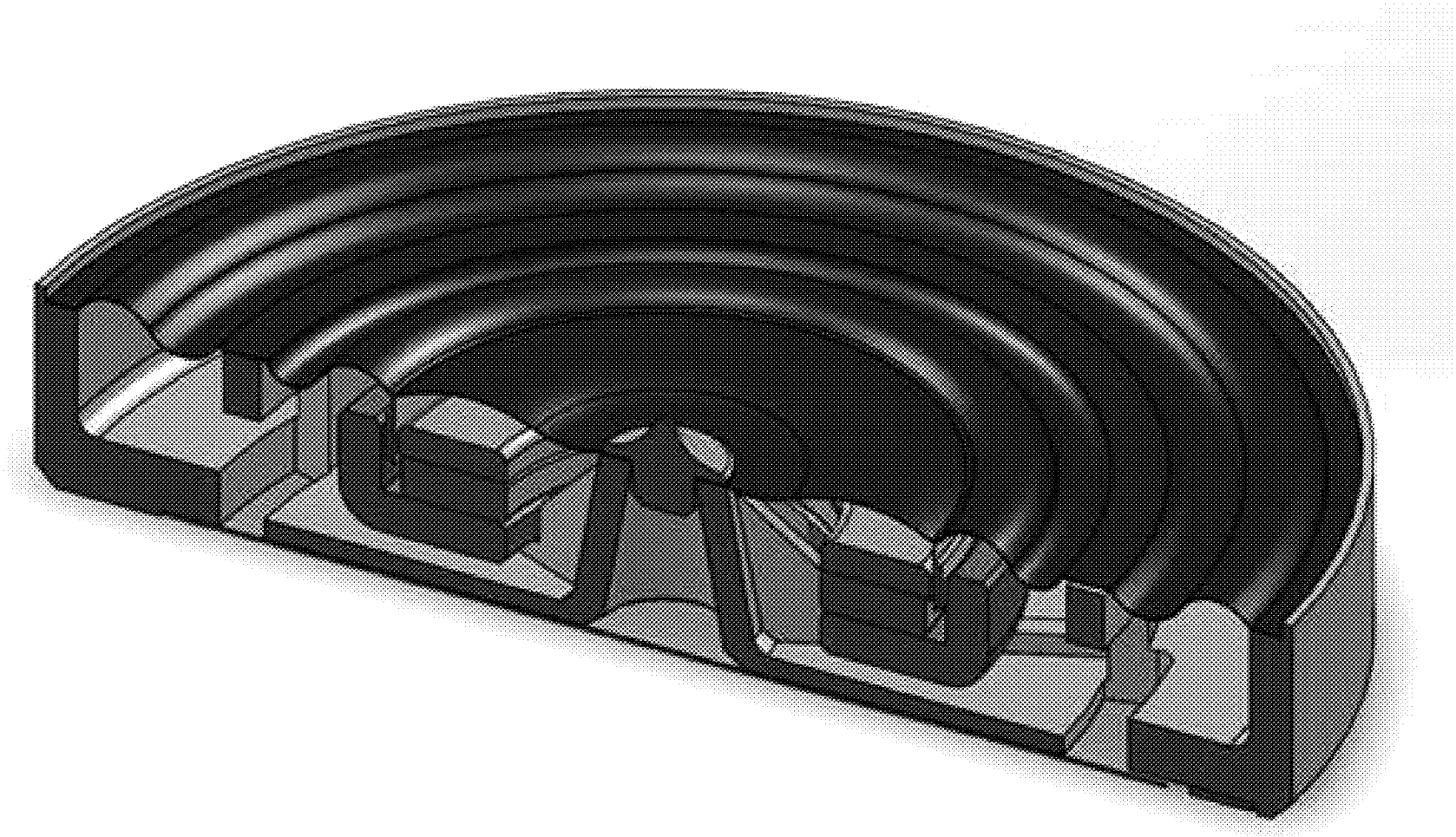
FIG. 4 is a partial sectional view of the loudspeaker of FIG. 3.

FIGS. 3-4 show cross-sectional views of another embodiment of the inventive double ring radiator loudspeaker configuration.

Figure 5:
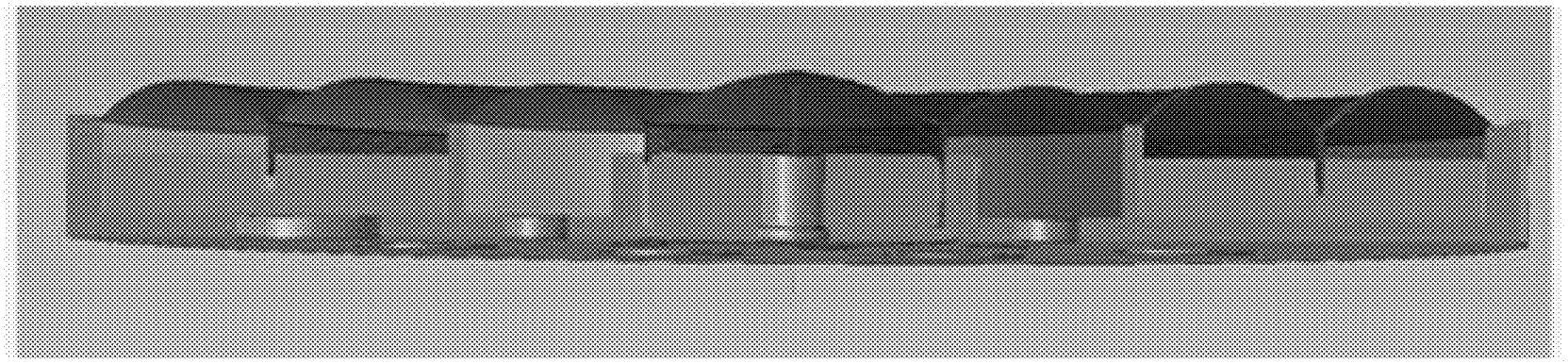
FIG. 5 is a cross-sectional view of a loudspeaker in another embodiment of the invention.
Figure 6:
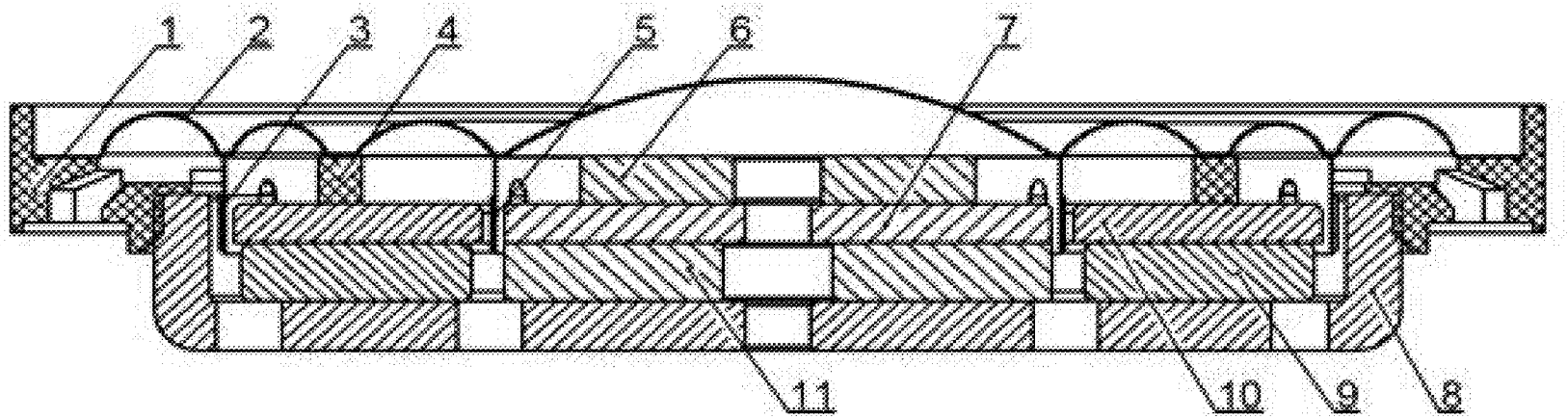
FIG. 6 is another sectional view thereof.

FIGS. 5-6 show cross-sectional views of yet another embodiment of the inventive double ring radiator loudspeaker configuration.

The present invention is disclosed by the preferred embodiment in the aforementioned description; however, it is contemplated for one skilled at the art that the embodiments are applied only for an illustration of the present invention rather than are interpreted as a limitation for the scope of the present invention. It should be noted that the various substantial alternation or replacement equivalent to these embodiments shall be considered as being covered within the scope of the present invention. Therefore, the protection scope of the present invention shall be defined by the claims.

What is claimed:

1. A loudspeaker comprising:

a driver, the driver comprising:

an inner magnet disposed within a housing of the loudspeaker;

an outer magnet disposed within the housing radially outward of the inner magnet;

an inner voice coil having a first diameter;

an outer voice coil having a second diameter, the second diameter being larger than the first diameter;

wherein poles of the inner and outer magnets are oppositely disposed;

wherein the inner magnet is configured to contribute only to a magnetic circuit of the inner voice coil; wherein the outer magnet is configured to contribute to the magnetic circuit of the inner voice coil and to a magnetic circuit of the outer voice coil;

the loudspeaker further comprising:

a yolk having a generally U-shaped cross-section disposed at a rear of the driver;

a frame secured to the yolk;

a diaphragm connected to the frame and extending across a front of the driver; and a phase plug disposed centrally at the front of the driver and protruding therefrom, wherein the diaphragm is said connected to the frame at a periphery of the loudspeaker and is also connected centrally to the phase plug.

2. The loudspeaker of claim 1, wherein the inner magnet is disposed centrally within the driver and the inner voice coil is disposed radially outward of the inner magnet.

3. The loudspeaker of claim 2, wherein the outer magnet is disposed radially outward of the inner voice coil and the outer voice coil is disposed radially outward of the outer magnet.

4. The loudspeaker of claim 3, wherein the inner magnet, the outer magnet, the inner voice coil, and the outer voice coil are disposed at an interior of the yolk of the loudspeaker having the generally U-shaped cross-section.

5. The loudspeaker of claim 1, wherein at least one of the inner and outer magnets are annularly shaped.

6. The loudspeaker of claim 1, wherein a north pole of the inner magnet is arranged at a front side of the driver proximate to a diaphragm of the loudspeaker.

7. The loudspeaker of claim 6, wherein a north pole of the outer magnet is arranged at a rear side of the driver opposite from the front side.

8. The loudspeaker of claim 1, wherein a north pole of the outer magnet is arranged at a front side of the driver proximate to a diaphragm of the loudspeaker.

9. The loudspeaker of claim 8, wherein a north pole of the inner magnet is arranged at a rear side of the driver opposite from the front side.

10. The loudspeaker of claim 1, wherein the magnetic circuit of the inner voice coil has a first magnetic force and the magnetic circuit of the outer voice coil has a second magnetic force.

11. The loudspeaker of claim 10, wherein the first magnetic force is greater than the second magnetic force.

12. A method of driving a loudspeaker, comprising:

providing an inner magnet disposed within a housing of the loudspeaker, providing an outer magnet disposed within the housing radially outward of the inner magnet, wherein poles of the inner and outer magnets are oppositely disposed;

providing an inner voice coil having a first diameter;

providing an outer voice coil having a second diameter being larger than the first diameter;

configuring the inner magnet to contribute only to a magnetic circuit of the inner voice coil;

configuring the outer magnet to contribute to the magnetic circuit of the inner voice coil and to a magnetic circuit of the outer voice coil;

disposing a yolk having a generally U-shaped cross-section at a rear of a driver of the loudspeaker, the driver being composed of the inner magnet, the outer magnet, the inner voice coil, and the outer voice coil;

securing a frame to the yolk;

connecting a diaphragm to the frame and extending across a front of the driver;

disposing a phase plug centrally at the front of the driver and protruding therefrom; and connecting the diaphragm to the frame at a periphery of the loudspeaker and centrally to the phase plug.

13. The method of claim 12, wherein magnetic circuit of the inner voice coil imparts a first magnetic force upon the inner voice coil, wherein the magnetic circuit of the outer voice coil imparts a second magnetic force upon the outer voice coil, and wherein the first magnetic force is greater than the second magnetic force.

* * * * *